US005284361A

United States Patent [19]

Walker et al.

[11] Patent Number: 5,284,361

[45] Date of Patent: Feb. 8, 1994

[54] MODULAR BOOK KIT AND METHOD OF ASSEMBLY

[76] Inventors: Thomas K. Walker, 86 Ipswich Rd., Topsfield, Mass. 01983; Dean Sherman, 5908 Lengewood Dr., Cincinnati, Ohio 45244; Clifford Koehler, 6509 Oregon Pass, West Chester, Ohio 45069

[21] Appl. No.: 860,027

[22] Filed: Mar. 30, 1992

[51] Int. Cl.[5] ..... B42D 1/00; B42F 13/04

[52] U.S. Cl. ..... 281/15.1; 281/51; 402/57; 402/80 P

[58] Field of Search ..... 281/51, 15.1; 402/50 P, 402/57

[56] References Cited

U.S. PATENT DOCUMENTS 2,586,556 2/1952 Mullikin ..... 402/57 X 5,163,768 11/1992 Salisbury et al. ..... 402/80 P X

*Primary Examiner*—Paul A. Bell

[57] ABSTRACT

A modular book which is uniquely adapted for a particular professor's course is formed by preassembling a plurality of different potential individually wrapped modules or chapters relating to a subject. Only selected ones of these modules are combined together and packaged along with a plastic spine protectors, front and back covers, and posts. The spine protector and posts are selected from a plurality of different spine protectors and posts so that they correspond in width to the combined thickness of the individual modules. These can all be boxed in a rectangular-shaped box that is easily stacked in a book store. Thus, a professor who is only interested in teaching a course relating to three topics can have a course book prepared which only includes those three modules. Another professor who wants five different topics to be taught in his course can have a course book uniquely prepared with only those five modules. A kit combining these features is also disclosed along with a method of combining the book and the book itself.

3 Claims, 3 Drawing Sheets

MODULAR BOOK KIT AND METHOD OF ASSEMBLY

BACKGROUND OF THE INVENTION

An educational textbook on a particular subject, for example computers, can deal with many different individual topics, all relating to the subject itself. Individual schools and professors, however, who teach that particular subject many times cannot cover all of these topics in one course. The aim and purpose of a particular course from a particular professor requires selection of the appropriate topics relating to that subject.

For example, if one teaches a course on learning how to use a computer, one may or may not wish to have a general discussion of computers and how they operate. They may teach how to use the various popular databases and software which are available for the computer. Certain software is uniquely suited for certain applications. If the course is directed at students who will be accountants or bookkeepers, accounting software would be emphasized. On the other hand, if the course is directed to students who will perform clerical work, word processing software may be emphasized.

This creates a problem for book publishers who want to sell a book that meets the needs of the professor. One way of meeting these needs is to have a very large book which covers a very large number of topics. Alternatively, several books can be published which teach only selected topics.

Another alternate method is to use a modular book. Modular books have been used for certain subjects. These have been formed by combining different chapters together and selling them with a three-ring binder. The chapters are simply placed in the three-ring binder and used in the course.

Three-ring binders simply are not as good as a regular book. Their irregular shape prevents them from being easily stacked in a book store. They are also oversized because the covers are necessarily larger than the pages. They also do not look as good as a regular book. Further, since modular books are by definition differing in thickness. Three-ring binders are particularly unsuitable for use with modular books. Either one must stock a large supply of three-ring binders of different sizes, or one simply sells one oversized binder for all applications.

Thus, although there have been modular books used for course work, these modular books have been unacceptable.

SUMMARY OF THE INVENTION

The present invention is premised on the realization that a modular book can be assembled and distributed without the disadvantages of using a three-ring binder by forming the modular book with a loose-leaf front and back cover combined with the individual modules and a plastic polyethylene spine protector. The books are assembled together with posts extending through the covers, modules and spine protector with screws holding the book together.

More particularly, the present invention is premised on the fact that these modular books can be distributed as a kit which incorporates a box, a group of unassembled modules, preferably individually shrink wrapped, a polyethylene spine protector having a width equal to the combined thickness of the modules, loose-leaf front and back covers with posts corresponding in thickness to the spine protector to assemble the book.

The book kits can be assembled by the publisher by selecting some but not all of the possible modules and a spine protector and posts of size equal to the thickness of the combined modules. These can be placed in a rectangular box with the spine protector placed along side the modules, preferably in its own compartment, along with front and back covers for the book. These are shrink wrapped and/or sealed for sale.

Optionally a group of adhesive-backed stickers can be combined with this kit wherein the cover itself has indicia, indicating where to place a plurality of selected stickers on the cover corresponding to the modules. Thus, the cover can be uniquely designed for the course itself.

According to the present invention, these kits can then be customized for each professor's course and will easily store in a book store. The fact that they are in a rectangular box enables them to be stacked in a bookstore without any tilt caused by the irregular shape of the packaging. Once assembled, the books look like books and not like three-ring binders. They are easy to carry just like other books. They are not oversized, and they will fit upright on a shelf and have an aesthetically appealing shelf presence. Also, any unsold kits can be returned to the publisher and the individual modules used in other books if desired.

The objects and advantages of the present invention will be further appreciated in light of the following detailed description and drawings in which:

DETAILED DESCRIPTION

Figure 1:
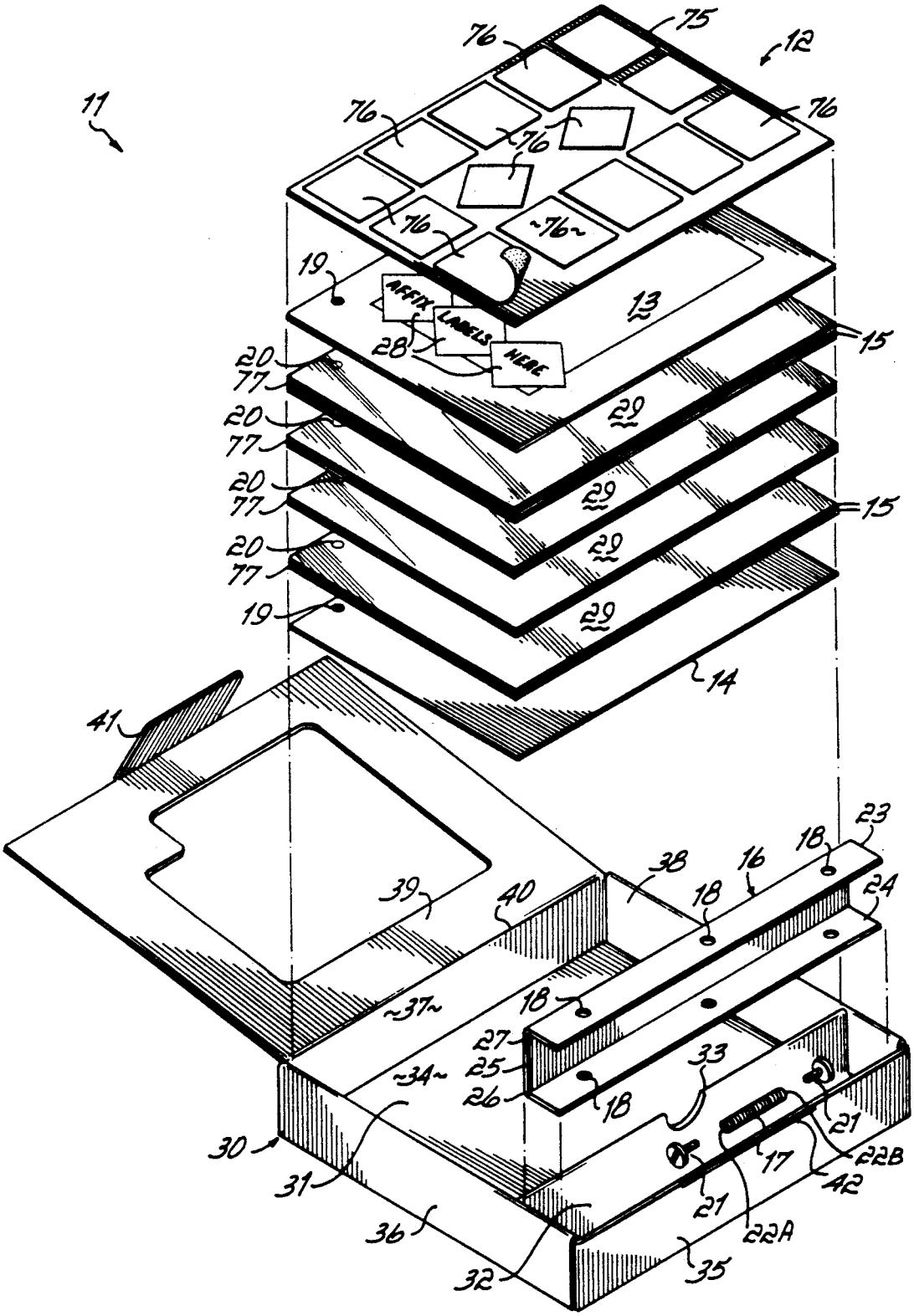
FIG. 1 is an exploded view of a kit showing the manner of assembly according to the present invention.

The present invention as shown in the drawings is a unique book 12 which includes a front cover 13, a rear cover 14, and pages 15. The front cover, rear cover and pages are bound to a polyethylene spine protector 16 by three posts 17, extended through holes 18 in the spine protector holes 19 in the cover and holes 20 in the pages. Screws 21 screw into either hollow ends **22*a* or 22*b* of the posts 17 to hold the covers, pages 15 and spine protector 16** together.

The spine protector 16 is a rigid plastic piece which has a length equal to the length of the pages 15. The spine protector 16 has three sections, two side sections 23 and 24 and a middle or rear section 25. These holes 18 in each side section 23 and 24 are aligned with each other, and aligned with the holes 19 in the covers and holes 20 through the pages. The rear section 25 is separated from the side sections 23 and 24 by score lines 26 and 27 along the length of the spine protector. These score lines form living hinges between side section 23 and rear section 25 and between rear section 25 and side section 24. Rear section 25 has a width approximately equal to the combined thickness of the pages 15, covers and side sections 23 and 24.

The posts 17 are formed from nickel-coated steel springs which are cut to the size equal to the width of the rear section 25 (as shown in FIG. 1) of spine protector 16. Screws 21 have a diameter slightly larger than the internal diameter of the spring posts 17 which enables them to be screwed into the hollow ends 22*a* and 22*b* of the posts 17. Due to the fact that the posts are formed from springs the hollow ends 22*a* and 22*b* do not have to be internally threaded to receive the screws.

Also as shown in FIG. 1, the front cover 13 includes indicia 28 which indicates a location to affix stickers bearing separate indicia. This will be used as described below to uniquely adapt the book cover 13 to correspond to the contents.

Figure 2:
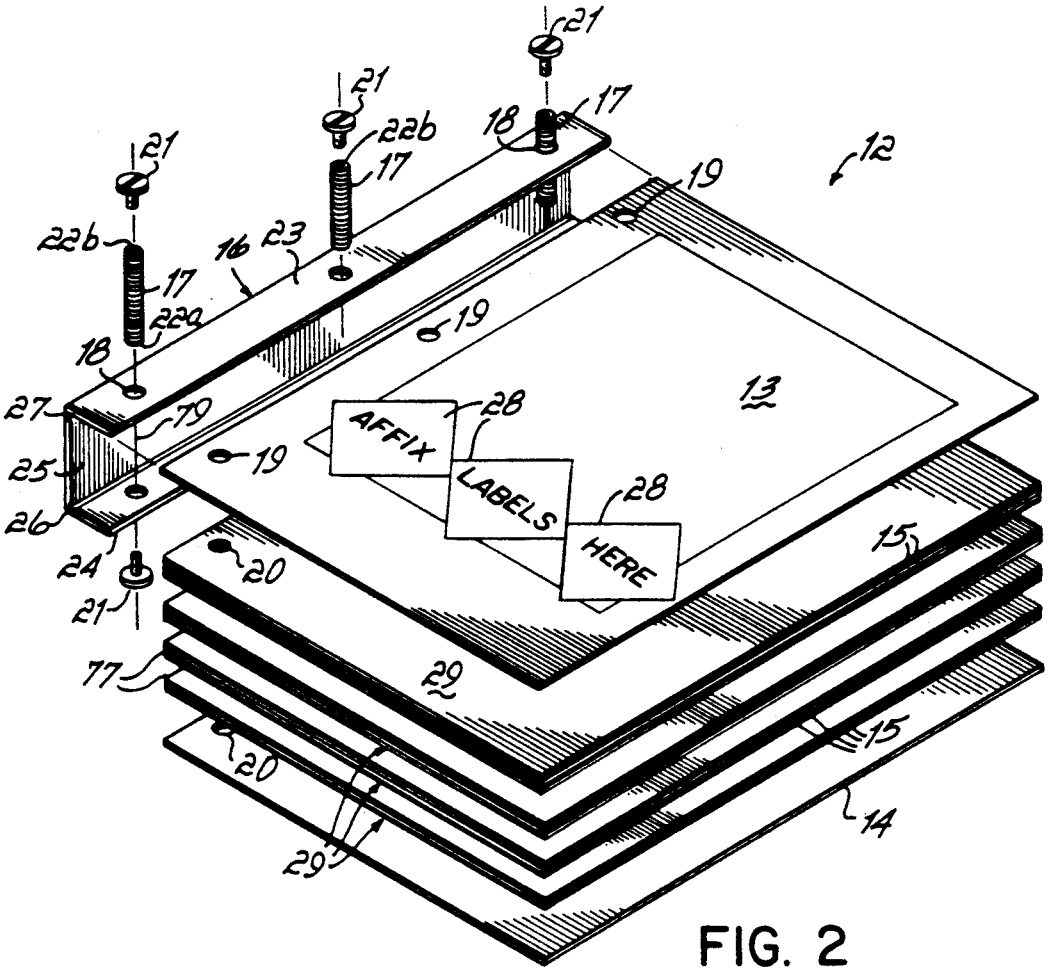
FIG. 2 is an exploded view of a book showing the manner of assembly in accordance with the present invention.
Figure 3:
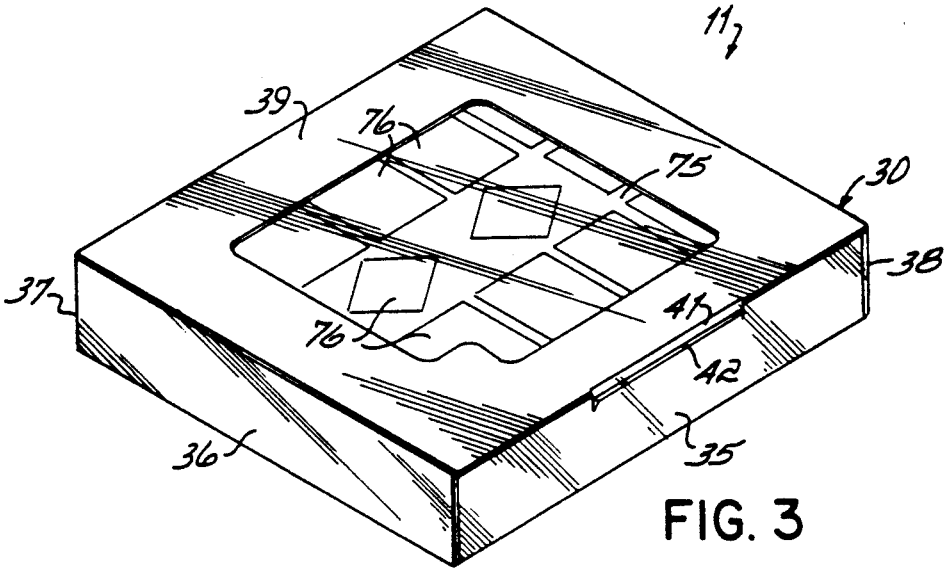
FIG. 3 is a perspective view of an assembled book kit.

The pages 15 of book 12 are made up of different modules 29 (four are shown in FIGS. 1 and 2). A module is a unit or chapter of a book formed from individual pages. In a preferred embodiment, each module covering a separate topic would include its own table of contents and perhaps an index. Each module is individually wrapped, preferably by shrink wrapping.

A book kit 11 (as shown in FIG. 1) would include some, but not all of the modules. For example, it may be desired to form a book four of ten possible modules. The four selected modules 29 (which are each individually shrink wrapped) would be combined and placed in a box 30. The box 30 is uniquely designed to store the components used to form book 12.

Box 30 includes a compartment 31 which is of the same size as the modules in width, and adapted of course to receive and hold the selected modules 29 and covers 13 and 14. Box 30 also includes a spine protector compartment 32 separated from the module compartment 31 by a divider 33. Box 30 also includes a bottom 34, side walls 35, 36, 37 and 38 and a top cover 39, which is hingedly connected to side wall 37 and fold line 40. Extending from cover 39 is a tab 41 which is adapted to extend into a slot 42 in the side wall 35.

Figure 4:
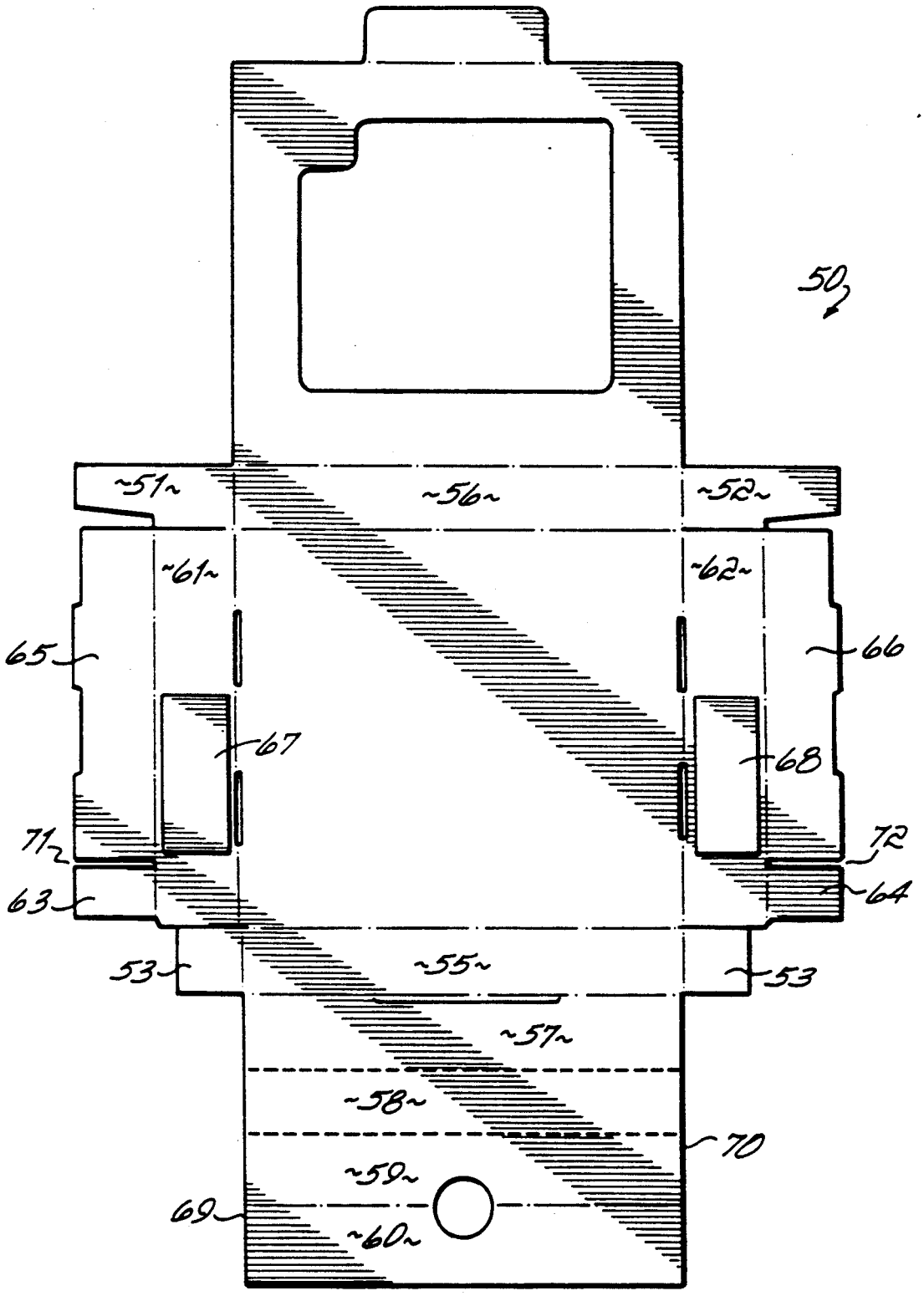
FIG. 4 is a plan view of a box blank for use in the present invention.

Although a number of blanks can be used to form box 30, an exemplary blank 50 is shown in FIG. 4. This is assembled by folding tabs 51, 52, 53 and 54 to 90°. Panels 56 and 55 would then be folded up 90°, and panels 57, 58, 59 and 60 would be folded over to form the spine protector compartment 32 and divider 33 (FIG. 1). Next, side walls 61 and 62 are folded up 90° and tabs 63 and 64 subsequently folded an additional 90°. Likewise, panels 65 and 66 would be folded an additional 90° to form the side walls 36 and 38. Between panels 65 and 61, and between panels 62 and 66, a piece of cardboard filler 67 and 68, respectively, can be inserted. This will cause the edges 69 and 70 of panels 59 and 60, which form divider 39, to lodge within notch 71 and 72, respectively. One skilled in the art of course could easily construct other blanks which would be used to form boxes which had both a module compartment and a spine protector compartment suitable for use in the present invention.

The disassembled book 12, as shown in FIG. 2, is formed by selecting modules 29 which are combined and placed in the module compartment 31 of box 30. The width of side walls 35, 36, 37 and 38 is large enough to hold most, if not all, of the modules which could be selected and added to the kit. However, if the combined thickness of the selected modules is not about equal to the height of the side walls, it may be preferable to add filler such as a scored pad (not shown) into the module compartment 31.

Once the selected modules are placed in compartment 31, front 13 and back covers 14 are added. It may be preferable to combine more than one front cover into the box 30. This will enable the student to select the appropriate cover for the combined modules. Also inserted in the kit at this time would be a group or sheet of stickers 75 (FIG. 1). Each of the stickers 76 would relate to a potential topic that would be covered by one of the modules. The front cover 13 includes indicia 28 showing the student where to affix one or more of the stickers 76 to uniquely design the front cover 13 to correspond to the modules contained within the book 12. Combined with the front covers 13, back cover 14 and sticker sheet 75 would be a general preface (not shown) and a an assembly instruction sheet (not show). These components would be shrink wrapped together. The order shown in FIG. 1 is illustratve. It may be preferable for marketing and assembly purposes to place a separate cover sheet on top, or place cover 13 on top and/or to prepackage the bottom cover, top cover(s) and B stickers together as a prewrapped module.

Next, a spine protector 16 and three posts (one shown) would be selected. There would be a plurality of different spine protectors, each having a rear section 25 with a different width which could be chosen. A spine protector would be chosen which has a width equal to the combined thickness of the selected modules. Thus, if three modules were used having a chosen thickness of approximately 0.5", a spine which has a rear section 25 of about 0.5" would be chosen. Also, spring posts 17 having the same 0.5" length would be chosen. If five modules were selected which had a combined thickness of 1", a spine protector having a rear section 25 approximately 1" wide would be selected. Likewise 1" long posts 17 would also be selected.

The selected spine protector 16, along with the selected posts 17 and screws 21, would then be placed in the spine compartment 32 of box 30. The top cover 39 of the box 30 would then be closed, and sealed and/or shrink wrapped to form the book kit 11.

To form the book, the student would arrange the modules in the order selected by the professor, unwrap and combine these together. The front cover would be placed on top of the modules and the back cover under the modules.

Next, the spine protector would be placed around the hole-punched edge 77 of the combined modules and covers with the holes 18 in the sides 23 and 24 of the spine protector 16 aligned with the holes 19 and 20 extending through the covers 13 and 14 and pages 15. A first screw 21 would be screwed into the first hollow end 22*b* of each of the posts 17 and the opposite end 22*a* of the post 17 would be inserted through the holes as shown by line 79. The second screw would then be screwed into the second hollow end 22*a* of each post 17.

Next, the front cover would be designed by taking selected stickers 76 from the sheet of stickers 75 and affixing these where indicated on the front cover 13.

The compiled book 12 has the look and feel of a normal soft covered textbook. The spine protector 16 is sized so that it holds the pages of the book together very tightly. The posts which are formed from steel springs provide several advantages. First, as the book is opened, the posts will bend making the book much easier to use and more durable, preventing the pages from being ripped out. Further, the spring posts do not require internal threading. Therefore, to stock a plurality of different posts having different lengths, one merely has to have the springs cut to the different lengths. This does not require a separate machining step and, therefore, is relatively inexpensive.

If rigid metal posts were employed, they would all have to be cut to size and machined to provide internal threading. Hollow plastic tubes could be employed in place of the spring steel, but these are less durable. They, however, would not require machining.

The present invention also provides a front cover that is uniquely selected for the modules. Thus, the present invention provides advantages for the professor, the student and the book manufacturer. This adds up to a very high quality, uniquely designed product at a reasonable price.

The preceding has been a description of the present invention and the method of practicing the present invention along with the best mode of practicing the invention currently known to the inventors.

However, the invention should be defined only by the appended claims wherein we claim:

1. A method of forming a book kit comprising:

forming a plurality of individually wrapped modules, each module comprising a plurality of hole-punched pages, gathering selected modules but not all of said modules together and placing said selected modules in a box, wherein said selected modules have a thickness;

providing a spine protector from a plurality of spine protectors, each of said spine protectors having two hole punched side sections and a rear section, said plurality of spine protectors having different widths; wherein said selected spine protector has a rear section having a width equal to the thickness of said selected modules and placing said selected spine protector in said box;

further adding to said box a plurality of posts having a length equal to the width of the rear section and side sections of said spine protector, said posts adapted to bind said modules and said spine protector together to form a book, wherein said package is sealed enclosing said modules, spine protector and posts in sid box in an unassembled form whereby a customer may assemble a book from said selected modules, said selected spine protector and said posts to form a book with pages tightly bound within said spine protector.

2. The method claimed in claim 1 further comprising adding front and back covers to said box.

3. The method claimed in claim 1 further comprising adding a plurality of stickers to said box.

* * * * *